US005879762A

United States Patent [19]

Lee et al.

[11] Patent Number: 5,879,762

[45] Date of Patent: Mar. 9, 1999

[54] METHOD FOR FORMING ELECTROMAGNETIC WAVE-SHIELDING FILM ON A PANEL USED IN A CATHODE RAY TUBE

[75] Inventors: Jong-hyuk Lee; Youn-hyeong Cho, both of Seoul; Dong-sik Jang, Koyang; Yun-ho Chon, Suwon, all of Rep. of Korea

[73] Assignee: Samsung Display Devices Co., Ltd., Kyonggi-do, Rep. of Korea

[21] Appl. No.: 99,003

[22] Filed: Jun. 17, 1998

[30] Foreign Application Priority Data

Jul. 2, 1997 [KR] Rep. of Korea ..... 1997 30680

[51] Int. Cl.[6] ..... B05D 3/06

[52] U.S. Cl. ..... 427/558; 427/64; 427/383.1

[58] Field of Search ..... 427/558, 64, 383.1

*Primary Examiner*—Bernard Pianalto
*Attorney, Agent, or Firm*—Baker & McKenzie

[57] ABSTRACT

A method for forming a face film on a face panel includes the steps of applying electromagnetic wave-shielding solution on the face panel, calcining the face panel, and photoreducing the precursor metal ion contained in the electromagnetic wave-shielding film by radiating ultraviolet ray on the face panel for about 20–50 minutes. The precursor is selected from silver or gold. Preferably, the step of calcining is conducted at a temperature of about 160°–200° C. Further preferably, the ultraviolet ray is in the range of 1–50 $mW/cm^2$.

8 Claims, No Drawings

METHOD FOR FORMING ELECTROMAGNETIC WAVE-SHIELDING FILM ON A PANEL USED IN A CATHODE RAY TUBE

BACKGROUND OF THE INVENTION

1. Field of the Invention

The present invention relates to a method for calcining a cathode ray tube and, more particularly, to a method for calcining a film, that can shield electromagnetic wave or prevent static electricity, on a face panel for a cathode ray tube.

2. Description of Related Art

Generally, a face panel of a cathode ray tube manufactured through an assembly line goes through a coating process of a nonglare film, an antistatic film, an antireflection film, or/and an electromagnetic wave-shielding film.

U.S. Pat. No. 5,660,876 to Kojima et al. discloses a method of manufacturing a cathode ray tube with a nonglare multi-layered film comprising at least a visible light absorbing layer containing a black dye, and an antistatic layer containing an inorganic metal compound used as a conductive agent.

U.S. Pat. No. 5,523,649 to Tong et al. discloses a video display panel having a multi-layered antireflective coating.

U.S. Pat. No. 5,652,477 discloses a display device having a multi-layered antistatic/antireflective coating.

The electromagnetic wave-shielding film for interrupting the electron waves is usually made of a single-layered structure having a silica layer or a dual-layered structure having antistatic and silica layers.

The antistatic layer comprises a transparent conductive coating layer made of a material selected from the group consisting of an ITO and ATO or comprises a thin metal layer made of Ag, Ag/Pd. The silica layer is made through a sol-gel method. As a well-known method for forming a silica film, water is added to silicon alkoxide for an hydrolysis reaction. Alcohol is used as a common solvent of the silicon alkoxide and the water. In addition, acid is used as a catalyst to derive hydrolysis and polycondensation so as to form a thin film.

Describing more in detail, in the sol-gel method for forming a silica thin film, the silica film is made through a silica sol composition, coating, drying, and heating treatment processes. That is, composition of the silica sol is realized by adding a predetermined amount of water to a precursor such as, for example, a tetraethyl-o-silicate or a tetramethyl-o-silicate so as to derive hydrolysis reaction. At this point, since the silicon alkoxide is hydrophobic, a common solvent such as ethanol, methanol, or butanol is added. After this, catalyst is further added to provide a sol particle structure that is suitable for being formed into thin film by a spin coating process or a dip-coating process and for accelerating hydrolysis reaction and polycondensation reaction.

Generally, when the silica layer is coated on the face panel, it is calcined at a temperature of about 300° C. using, for example, a ceramic heater so that the organization of the film is fined and the attachment thereof can be stabilized. This calcination process is performed as a final process for making the cathode ray tube so as to prevent the surface of the silica film from being physically and chemically damaged.

However, since the calcination process is locally performed in the face panel of the cathode ray tube, resulting in thermal expansion difference between the panel, explosion proof band, and a funnel, there is a drawback in that the cathode ray tube can be cracked. In addition, since the phosphor layer can be damaged by the high temperature, the quality of the cathode ray tube is deteriorated. Furthermore, gas is generated inside the cathode ray tube by thermal decomposition, deteriorating a degree of vacuum.

SUMMARY OF THE INVENTION

Therefore, there is a need for a calcining method which can form the silica film on a panel of a cathode ray tube while eliminating the above described problems.

To achieve the above object, the present invention provides a method for forming a face film on a face panel, comprising the steps of:

applying electromagnetic wave-shielding solution containing a precursor on the face panel;

calcining the face panel applied electromagnetic wave-shielding film; and photoreducing the precursor metal ion contained in the electromagnetic wave-shielding film by radiating ultraviolet ray on the panel for about 20–50 minutes.

Preferably, the precursor is selected from the group consisting of silver and gold.

Further preferably, the step of calcining is conducted at a temperature of about 160°–200° C.

The ultraviolet ray is in the range of 1–50 mW/cm$^2$.

According to another aspect of the present invention, the face film can be formed on a face panel according to the following steps of:

applying electromagnetic wave-shielding solution containing the precursor on the face panel;

photoreducing the precursor metal ion contained in the electromagnetic wave-shielding film by radiating ultraviolet ray on the panel for about 20–50 minutes; and calcining the face panel.

DETAILED DESCRIPTION OF PREFERRED EMBODIMENTS

Detailed description of preferred embodiments of the present invention will be described hereinafter.

First Embodiment

After preparing a mixed solvent composed of methanol of 20 wt %, ethanol of 67.5 wt %, and n-butanol of 10 wt %, a first application solution was made by dispersing ITO particles, having a diameter of 80 nm, of 2.5 wt % into the mixed solvent.

In addition, after preparing a mixed solvent composed of methanol of 29 wt %, ethanol of 49 wt %, n-butanol of 12 wt %, and distilled water of 3.9 wt %, a second application solution was made by adding tetraethyl-o-silicate of 4.4 wt %, nitric acid of 0.6 wt %, and silver nitrate of 0.3 wt % into the mixed solvent with agitating for about 24 hours at room temperature.

After this, 50 cc of the first application solution was applied to the face panel while rotating the panel at 90 rpm. By increasing the rotating speed of the panel to 150 rpm, the first application solution was spin-coated on the panel. In the same manner, 60 cc of the second application solution was coated on the face panel.

The cathode ray tube having the face panel coated with the first and second application solutions was dried and calcined for about 30 minutes at a temperature of 180° C., thereby obtaining a transparent conductive film.

After then, several cathode ray tubes were prepared in the above manner and exposed to ultraviolet (UV) ray radiated from a UV lamp of 1 mW/cm$^2$ for different times so that a precursor can be extracted.

The following table 1 shows measured resistance values of the films exposed to ultraviolet ray for different durations of time.

TABLE 1

| Exposure time | 0 | 20 minutes | 30 minutes | 50 minutes |
|---|---|---|---|---|
| R/V(Ω/□) | $10.39 \times 10^3$ | $8.27 \times 10^3$ | $7.98 \times 10^3$ | $7.40 \times 10^3$ |

As shown in table 1, the resistance value of the film is varied in accordance with exposure time of the ultraviolet ray because the precursor is extracted by the ultraviolet ray.

Accordingly, the resistance value is directly proportional to the exposure time. However, if the exposure time is above 50 minutes, the precursor is no longer extracted such that the resistance value is not varied.

Second Embodiment

In this second embodiment, upon spin-coating the first and second application solutions, the panel was exposed to ultraviolet ray for about 30 minutes, and then calcining the same at a temperature of 180° C. for 30 minutes, thereby obtaining a transparent conductive film.

Following table 2 shows resistance values of the film which is formed without ultraviolet exposure and the film which is formed with ultraviolet exposure.

TABLE 2

| Exposure time | 0 | 30 minutes |
|---|---|---|
| R/V(Ω/□) | $10.10 \times 10^3$ | $9.35 \times 10^3$ |

As shown in table 2, if the film is exposed to the ultraviolet ray, the resistance valve is reduced. However, as can be seen from the tables 1 and 2, if the film is exposed to the ultraviolet ray after the calcination, the resistance value can be further reduced.

As described above, since the precursor is extracted by radiating ultraviolet ray on the electromagnetic wave-shielding film coated on the face panel of the cathode ray tube, the calcination temperature can be reduced.

Therefore, in the present invention, since the calcination temperature can be reduced, differences in thermal expansion between the panel, explosion proof band, and a funnel does not occur, preventing the cathode ray tube from cracking. In addition, the time for cooling process of the cathode ray tube can be reduce, increasing the manufacturing efficiency thereof.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for forming a face film on a face panel, comprising the steps of:

applying electromagnetic wave-shielding solution on the face panel;

calcining the face panel applied electromagnetic wave-shielding film; and photoreducing a precursor metal ion contained in the electromagnetic wave-shielding film by radiating ultraviolet ray on the panel for about 20–50 minutes.

2. The method of claim 1, wherein the precursor is selected from the group consisting of silver and gold.

3. The method of claim 1, wherein the step of calcining is conducted at a temperature of about 160°–200° C.

4. The method of claim 1, wherein the ultraviolet ray is in the range of 1–50 mW/cm$^2$.

5. A method for forming a face film on a face panel, comprising the steps of:

applying electromagnetic wave-shielding solution on the face panel;

photoreducing a precursor metal ion contained in the electromagnetic wave-shielding film by radiating ultraviolet ray on the face panel for about 20–50 minutes; and calcining the face panel.

6. The method of claim 5, wherein the precursor is selected from the group consisting of silver and gold.

7. The method of claim 5, wherein the step of calcining is conducted at a temperature of about 160°–200° C.

8. The method of claim 5, wherein the ultraviolet ray is in the range of 1–50 mW/cm$^2$.

* * * * *